US009770156B2

(12) United States Patent
Xu

(10) Patent No.: US 9,770,156 B2
(45) Date of Patent: Sep. 26, 2017

(54) MACERATOR ASSEMBLY FOR APPLIANCES

(71) Applicant: General Electric Company, Schenectady, NY (US)

(72) Inventor: Hanping Xu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 218 days.

(21) Appl. No.: 14/822,029

(22) Filed: Aug. 10, 2015

(65) Prior Publication Data

US 2017/0042403 A1 Feb. 16, 2017

(51) Int. Cl.

| | |
|---|---|
| ***A47L 15/42*** | (2006.01) |
| ***A47L 15/23*** | (2006.01) |
| ***F04D 29/22*** | (2006.01) |

(52) U.S. Cl.

CPC ..... *A47L 15/4227* (2013.01); *A47L 15/23* (2013.01); *F04D 29/2288* (2013.01)

(58) Field of Classification Search

CPC ..... A47L 15/42

See application file for complete search history.

(56) References Cited

U.S. PATENT DOCUMENTS

| | | | | |
|---|---|---|---|---|
| 5,770,058 | A * | 6/1998 | Jozwiak | A47L 15/4206 134/104.1 |
| 8,888,931 | B2 | 11/2014 | Watson et al. | |
| 2013/0319485 | A1 | 12/2013 | Blanchard et al. | |

FOREIGN PATENT DOCUMENTS

| | | | |
|---|---|---|---|
| KR | 20120107593 | A | 10/2012 |
| KR | 20140119453 | A | 10/2014 |

* cited by examiner

*Primary Examiner* — Jason Ko

(74) *Attorney, Agent, or Firm* — Dority & Manning, P.A.

(57) ABSTRACT

A macerator assembly for an appliance circulation pump that improves pump and appliance performance. The macerator assembly includes an inner and outer cylinder concentrically disposed along a longitudinal axis. Each cylinder has a plurality of apertures defined by cutting edges. One or both of the inner and outer cylinders are rotated such that the cutting edges of the apertures fully filter and chop large incoming particles into smaller pieces.

13 Claims, 7 Drawing Sheets

MACERATOR ASSEMBLY FOR APPLIANCES

FIELD OF THE INVENTION

The present subject matter relates generally to dishwashers, and more particularly to a dishwasher macerator assembly.

BACKGROUND OF THE INVENTION

During wash and rinse cycles, dishwashers typically circulate a fluid through the wash chamber and over articles such as pots, pans, silverware, and other cooking utensils. The fluid can be e.g., various combinations of water and detergent during the wash cycle or water (which may include additives) during the rinse cycle. Typically the fluid is recirculated during a given cycle using a pump. Fluid is collected at or near the bottom of the wash chamber and pumped back into the chamber through e.g., nozzles in the spray arms and other openings that direct the fluid against the articles to be cleaned or rinsed. Depending upon the level of soil upon the articles, the fluid will become contaminated with the soil in the form of debris and particles that are carried with the fluid. It is desirable to remove or chop up the larger particles in the fluid to prevent clogging of the pump and nozzles in the spray arms, and to improve appliance performance.

Conventional dishwashers include a macerator assembly having a rotating chopper blade to pulverize and break down relatively large food particles. The chopper blade is typically placed at the pump inlet and chops up particles in the incoming fluid to a size that allows the particles to pass through the relatively small spray arm jet holes. However, such macerators have limited cutting efficiency. Therefore, even with a macerator blade, conventional macerator assemblies are used in conjunction with a filter system consisting of coarse and fine filters. The filters remove particles that are too large to be macerated by the macerator assembly, or that otherwise are not effectively chopped by the blade. The macerator blade and coarse and fine filters require additional space and result in additional components and manufacturing costs.

Accordingly, it would be desirable to provide a dishwasher with an improved macerator assembly that eliminates the need for including coarse and fine filters, reduces the number of necessary components, simplifies structure, and provides a compact pump assembly that provides dynamic 100% maceration and filtration.

BRIEF DESCRIPTION OF THE INVENTION

The present subject matter provides a macerator assembly for an appliance circulation pump that improves pump and appliance performance. The macerator assembly includes an inner and outer cylinder concentrically disposed along a longitudinal axis. Each cylinder has a plurality of apertures defined by cutting edges. One or both of the inner and outer cylinders are rotated such that the cutting edges of the apertures fully filter and chop large incoming particles into smaller pieces. In this manner, the macerator assembly macerates 100% of incoming particles and effectively provides 100% system filtration. Conventional chopping blades and coarse and fine filters may thereby be eliminated, resulting in a simplified structure that achieves dynamic 100% filtration and clog-free pump operation. Additional aspects and advantages of the invention will be set forth in part in the following description, or may be apparent from the description, or may be learned through practice of the invention.

In one exemplary embodiment, a dishwasher is provided. The dishwasher includes a wash chamber for receipt of articles for washing; a sump for collecting wash fluid; and a pump assembly for circulating wash fluid for cleaning the articles. The pump assembly includes a motor, a shaft, a pump, a housing, an inlet in fluid communication with the sump, and an outlet in fluid communication with the wash chamber. The dishwasher further includes a macerator assembly including an inner cylinder and an outer cylinder concentrically disposed along a longitudinal axis. The inner cylinder has a first plurality of elongated slots extending from a first end of the inner cylinder to a second end of the inner cylinder and forming a non-zero angle with the longitudinal axis. The outer cylinder has a second plurality of elongated slots extending from a first end of the outer cylinder to a second end of the outer cylinder and forming a non-zero angle with the longitudinal axis. At least one of the inner cylinder and the outer cylinder is rotated by the motor such that relative rotation between the inner cylinder and the outer cylinder causes the first plurality of slots and the second plurality of slots to act as shearing edges to macerate particles in the wash fluid.

In another exemplary embodiment, a circulation pump for an appliance is provided. The circulation pump includes a motor; a pump; an inlet in fluid communication with a sump for collecting wash fluid; an outlet in fluid communication with a wash chamber; and a macerator assembly. The macerator assembly includes an inner cylinder and an outer cylinder concentrically disposed along a longitudinal axis. The inner cylinder has a first plurality of apertures defined at least in part by a first plurality of cutting edges angled toward an exterior surface of the inner cylinder. The outer cylinder has a second plurality of apertures defined at least in part by a second plurality of cutting edges angled toward an interior surface of the outer cylinder. A shaft of the motor is coupled to one of the inner cylinder and the outer cylinder to cause relative rotation between the inner cylinder and the outer cylinder, such that the first plurality of cutting edges and the second plurality of cutting edges act as shearing edges to macerate particles in the wash fluid.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
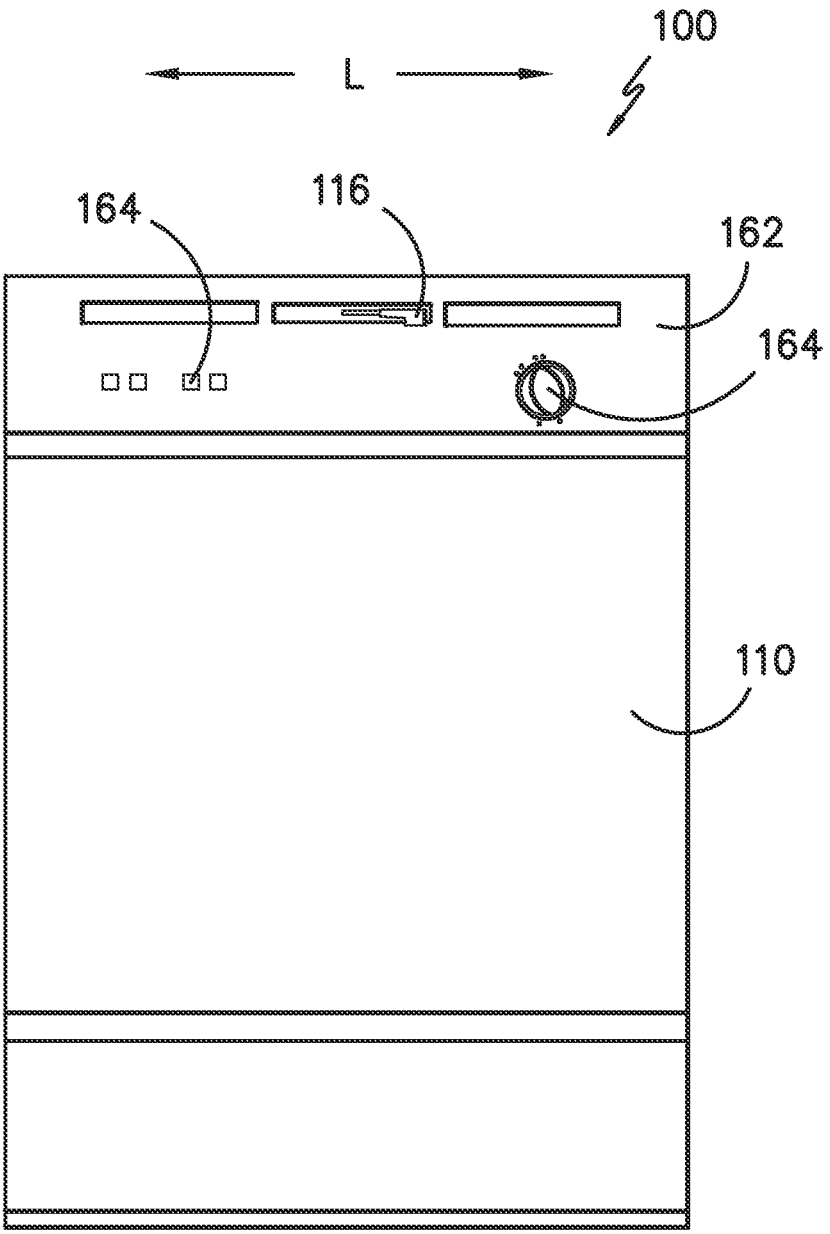
FIG. 1 provides a front view of an exemplary embodiment of a dishwashing appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as example embodiments disclosed herein are not limited to the vertical orientation shown nor to any particular configuration shown; other constructions and orientations may also be used.

As discussed in greater detail below, embodiments of the present invention relate to a dishwasher having an improved macerator assembly. FIG. 1 depicts an exemplary domestic dishwasher 100 that may be configured in accordance with aspects of the invention. It should be appreciated that the invention is not limited to any particular style, model, or configuration of dishwasher, and that the embodiment depicted in FIG. 1 is for illustrative purposes only. Moreover, embodiments of the present invention are applicable to other appliances as well. For example, embodiments may be used in any appliance where large particles from incoming wash fluid needs to be reduced into smaller sizes for better pump performance.

Figure 2:
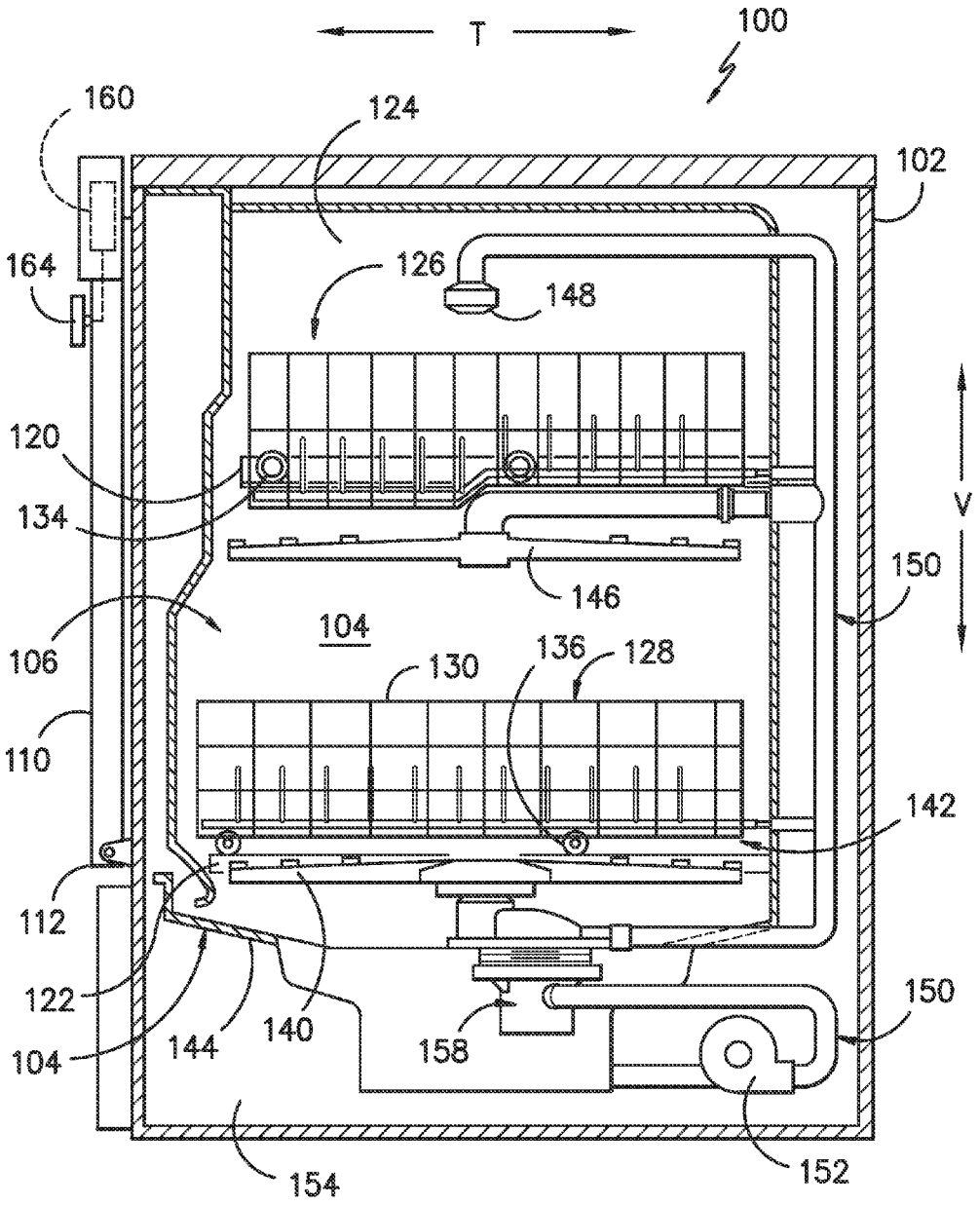
FIG. 2 provides a side, cross-sectional view of the exemplary dishwashing appliance of FIG. 1.

For the particular embodiment of FIGS. 1 and 2, the dishwasher 100 includes a cabinet 102 having a tub or inner liner 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 is sealed shut for washing operation, and a horizontal open position for loading and unloading of articles from the dishwasher 100. Latch 116 is used to lock and unlock door 110 for access to chamber 106.

Upper and lower guide rails 120, 122 are mounted on tub side walls 124 and accommodate roller-equipped rack assemblies 126 and 128. Each of the rack assemblies 126, 128 is fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by the racks 126, 128.

The dishwasher 100 further includes a lower spray-arm assembly 140 that is rotatably mounted within a lower region 142 of the wash chamber 106 and above a tub sump portion 144 so as to rotate in relatively close proximity to rack assembly 128. A mid-level spray-arm assembly 146 is located in an upper region of the wash chamber 106 and may be located in close proximity to upper rack 126. Additionally, an upper spray assembly 148 may be located above the upper rack 126.

The lower and mid-level spray-arm assemblies 142, 146 and the upper spray assembly 148 are part of a fluid circulation assembly 150 for circulating water and dishwasher fluid in the tub 104. The fluid circulation assembly 150 also includes a pump assembly 152 positioned in a machinery compartment 154 located below the tub sump portion 144 (i.e., bottom wall) of the tub 104, as generally recognized in the art. As wash fluid is pumped through the spray arm assemblies 140, 146, and 148, washing sprays into the wash chamber 106, and wash fluid collects in the sump 144. The sump 144 may include a cover to prevent larger objects from entering the sump 144, such as a piece of silverware or another dishwasher item that is dropped beneath lower rack assembly 128. In addition, as discussed in detail below, the pump assembly 152 may include a macerator assembly 156 (FIG. 3) in accordance with example embodiments of the present invention for further chopping up particles in the wash fluid.

In the illustrated embodiment, the fluid circulation assembly 150 also includes a diverter 158. Diverter 158 controls the flow of fluid in the dishwashing appliance, for example, to selectively control which flow assemblies receive a flow of fluid. Therefore, pump assembly 152 receives fluid from sump 144 and provides a flow to an inlet of the diverter 158, which selectively supplies a flow of fluid to one or more of spray assemblies 140, 146, and 148.

Each of the lower and mid-level spray-arm assemblies 140, 146 includes an arrangement of discharge ports or orifices for directing washing fluid received from diverter 158 onto dishes or other articles located in rack assemblies 126 and 128. The arrangement of the discharge ports in spray-arm assemblies 140, 146 provides a rotational force by virtue of washing fluid flowing through the discharge ports. The resultant rotation of the spray-arm assemblies 140, 146 and the operation of spray assembly 148 using fluid from diverter 158 provides coverage of dishes and other dishwasher contents with a washing spray. Other configurations of spray assemblies may be used as well.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 160 may be positioned in a variety of locations throughout dishwasher 100. In the illustrated embodiment, the controller 160 may be located within a control panel area 162 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for racks 126, 128, and other differences may be applied as well.

Referring to FIGS. 3 through 6, a pump assembly 152 and macerator assembly 156 according to an exemplary embodiment will now be described. The pump assembly 152 includes a pump housing 200, a motor 202, a drive shaft 204, and an impeller 206. An inlet 208 is in communication with the sump 144 and an outlet (not shown) discharges wash fluid to the diverter 158 or wash chamber 106. The motor 202 drives the impeller 206 that is attached to a drive shaft 204. The drive shaft 204 may be a unitary drive shaft that is a component of the rotor of the motor 202. The impeller 206 may include a hub (not shown) that is mounted to the drive shaft 204, as well as a plurality of impellor blades (not shown) that rotate within a pump chamber 210, as is commonly known.

Pump assembly 152 may further include macerator assembly 156, which is used to chop up large particles entrained in the wash fluid into smaller particles before the wash fluid enters the pump inlet 208. According to one embodiment, macerator assembly 156 includes an inner cylinder 212 and an outer cylinder 214 concentrically disposed along a longitudinal axis A. The inner cylinder 212 may include a cylindrical wall 220 disposed between a capped end 222 and an open end 224. Similarly, the outer cylinder 214 may include a cylindrical wall 226 disposed between a capped end 228 and an open end 230.

Figure 3:
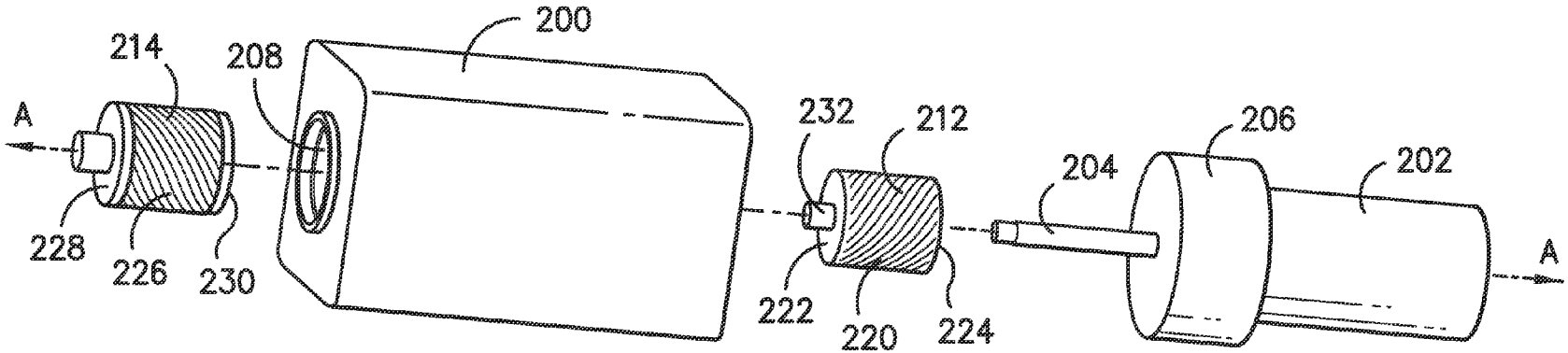
FIG. 3 provides an exploded, perspective view of a pump and macerator assembly according to an exemplary embodiment of the present subject matter where an inner cylinder is configured to rotate.
Figure 4:
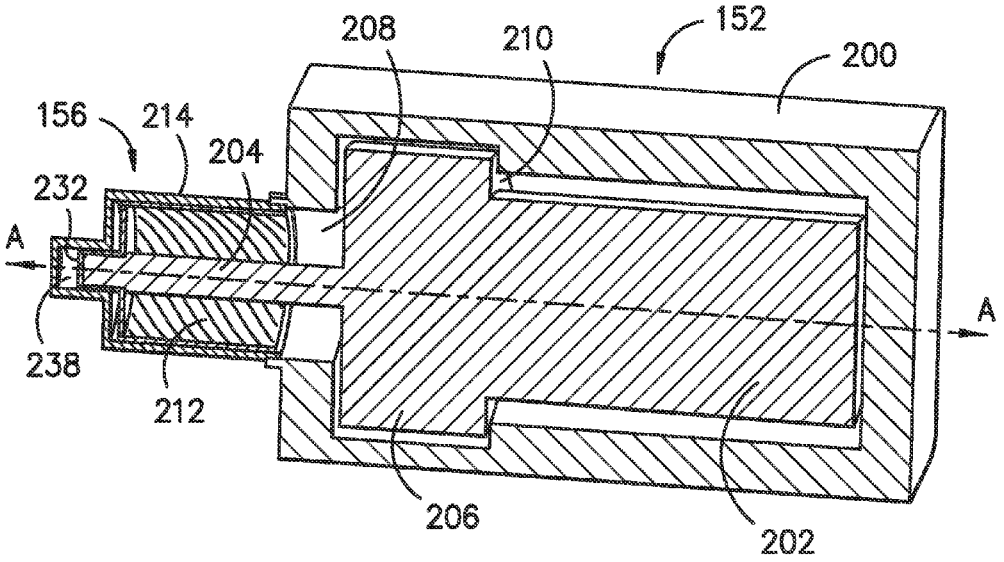
FIG. 4 provides a perspective, cross-sectional view of a pump and macerator assembly according to an exemplary embodiment of the present subject matter where the inner cylinder is configured to rotate.
Figure 5:
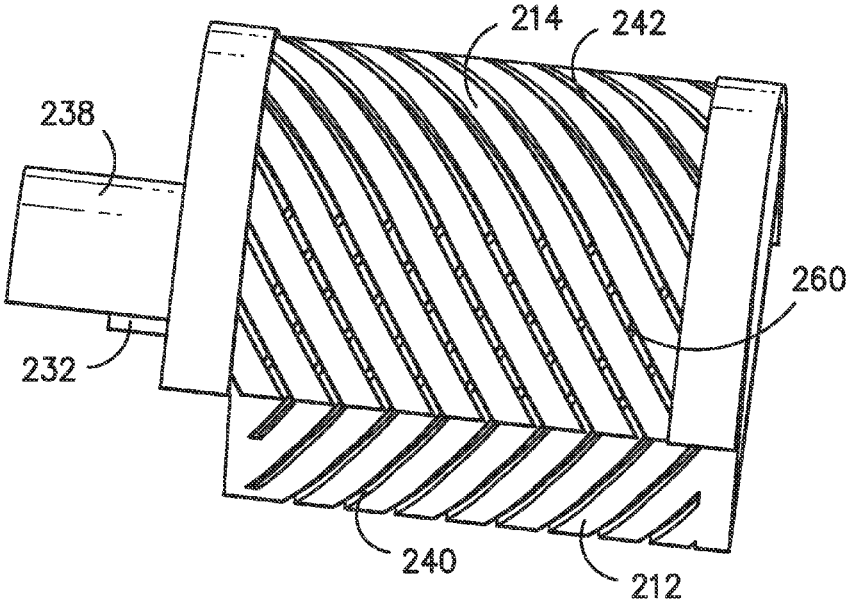
FIG. 5 provides an exploded, perspective view of a pump and macerator assembly according to an exemplary embodiment of the present subject matter where an outer cylinder is configured to rotate.

As shown in FIGS. 3 and 4, the capped end 222 of inner cylinder 212 defines a boss 232 positioned along longitudinal axis A. Boss 232 defines a first end 234 positioned toward the interior of the inner cylinder 212 and a second end 236 extending away from capped end 222 of inner cylinder 212. The first end 234 may be configured to receive drive shaft 204, which extends along longitudinal axis A through the center of the inner cylinder 212 and attaches to first end 234 of boss 232. The capped end 228 of outer cylinder 214 defines a recess 238 that is positioned along the longitudinal axis A and is configured to receive the second end 236 of boss 232 of inner cylinder 212. The boss 232 and recess 238 help maintain the axial alignment of the inner cylinder 212, outer cylinder 214, and drive shaft 204. In this manner, inner cylinder 212 and outer cylinder 214 share an axis of rotation (i.e., longitudinal axis A) with the motor 202, drive shaft 204, and impeller 206.

The inner cylinder 212 and the outer cylinder 214 may further define a first plurality of apertures 240 and a second plurality of apertures 242, respectively. The first plurality of apertures 240 are defined by a first plurality of cutting edges 244 and the second plurality of apertures 242 are defined by a second plurality of cutting edges 246. More specifically, the first plurality of cutting edges 244 may include a first side 248 and a second side 250. Similarly, the second plurality of cutting edges 246 may include a first side 252 and a second side 254. When the inner cylinder 212 is disposed inside the outer cylinder 214, the first plurality of apertures 240 and the second plurality of apertures 242 define a matrix of shearing holes 260 through which wash fluid may flow.

In operation, motor 202 rotates drive shaft 204, which is attached to impeller 206 and inner cylinder 212. Outer cylinder 214 is fixed to pump housing 200, and therefore remains stationary. As motor 202 rotates, the impeller 206 draws in wash fluid and particles entrained in the wash fluid impinge on the outer cylinder 214. At the same time, inner cylinder 212 rotates relative to the outer cylinder 214, such that the matrix of shearing holes 260 is constantly changing and shearing particles that become lodged within the shearing hole 260. More specifically, as inner cylinder 212 and outer cylinder 214 rotate relative to each other, the first plurality of cutting edges 244 and the second plurality of cutting edges 246 move such that the matrix of shearing holes 260 may shear any particles drawn into the macerator assembly 156 along with the wash fluid.

Notably, the size of the shearing holes 260 depends on the geometry of the first plurality of apertures 240 and the second plurality of apertures 242. Thus, the first plurality of apertures 240 and the second plurality of apertures 242 may be designed to allow small particles to pass through the macerator assembly 156. By contrast, large particles cannot pass through, and instead become trapped in the shearing holes 260 defined by the first plurality of apertures 240 and the second plurality of apertures 242. For example, particles larger than the shearing hole 260 may impinge on the outer cylinder 214 and become lodged in the shearing hole 260. The rotating inner cylinder 212 will begin shearing off portions of the particle until the remainder of the particle is small enough to pass through the shearing hole 260. In an example embodiment, each shearing hole 260 may be designed such that it is slightly smaller than the nozzles or orifices on the spray-arm assemblies 140, 146, and 148. In this manner, all particles may pass through the nozzles and be recirculated continuously without clogging the fluid circulation assembly 150.

As shown in the figures, the first plurality of apertures 240 extends from a first end (e.g., capped end 222) to a second end (e.g., open end 224) of inner cylinder 212. The first plurality of apertures 240 forms a non-zero angle with the longitudinal axis A. For example, the first plurality of apertures 240 may be angled between about 15 and 75 degrees relative to the longitudinal axis A. In other suitable embodiments, the first plurality of apertures 240 may be angled between about 30 and 60 degrees. In the illustrated embodiment, the first plurality of apertures 240 is angled at approximately 45 degrees relative to the longitudinal axis A.

Similarly, the second plurality of apertures 242 extends from a first end (e.g., capped end 228) to a second end (e.g., open end 230) of outer cylinder 214. The second plurality of apertures 242 forms a non-zero angle with the longitudinal axis A. For example, the second plurality of apertures 242 may be angled between about −15 and −75 degrees relative to the longitudinal axis A. In other suitable embodiments, the second plurality of apertures 242 may be angled between about −30 and −60 degrees. In the illustrated embodiment, the second plurality of apertures 242 is angled at approximately −45 degrees relative to the longitudinal axis A.

As shown in FIGS. 3 through 6, each of the first plurality of apertures 240 and the second plurality of apertures 242 are elongated slots. However, one skilled in the art will appreciate that the first plurality of apertures 240 and the second plurality of apertures 242 may be shaped differently, and elongated slots are used only as an example. The first plurality of apertures 240 and the second plurality of apertures 242 may be of different number, shape, and size and remain within the scope of the invention. Similarly, the first plurality of apertures 240 and the second plurality of apertures 242 may be angled and positioned in any manner suitable for achieving the desired maceration effect (discussed below). For example, the first plurality of apertures 240 and the second plurality of apertures 242 may be circular holes, serpentine slots, or any other shape suitable for the purposes of maceration.

Figure 6:
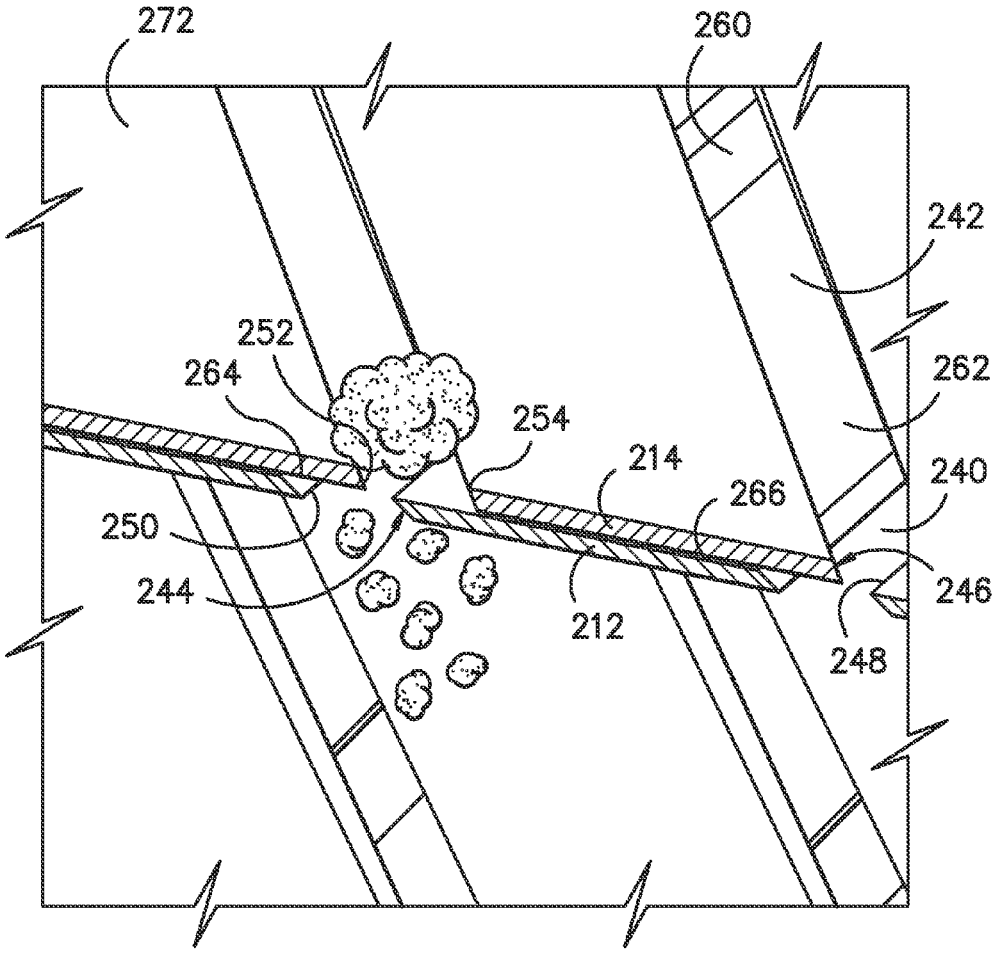
FIG. 6 provides a perspective, cross-sectional view of a pump and macerator assembly according to an exemplary embodiment of the present subject matter where the outer cylinder is configured to rotate.

As best shown in FIG. 6, the first plurality of apertures 240 and the second plurality of apertures 242 may be defined by angled edges. More specifically, the first plurality of apertures 240 may be defined at least in part by the first plurality of cutting edges 244. In the illustrated embodiment, each of the first plurality of apertures 240 has a first side 248 angled toward an exterior surface 262 of the inner cylinder 212 and a second side 250 angled away from the exterior surface 262 of the inner cylinder 212. Conversely, the second plurality of apertures 242 may be defined at least in part by the second plurality of cutting edges 246. In the illustrated embodiment, each of the second plurality of apertures 242 has a first side 252 angled toward an interior surface 264 of the outer cylinder 214 and a second side 254 angled toward an exterior surface 272 of the outer cylinder 214.

As the inner cylinder 212 and outer cylinder 214 are rotated relative to each other, the first plurality of cutting edges 244 and the second plurality of cutting edges 246 act as shearing edges to cut, chop, or otherwise macerate large particles in the wash fluid. The shearing effect is achieved, for example, as the first plurality of cutting edges 244 moves by the second plurality of cutting edges 246. As shown in the illustrated embodiment, a particle is macerated as first side 248 of inner cylinder 212 passes first side 252 of outer cylinder 214, such that the particle tends to slide along first side 248 of inner cylinder 212 as it is cut by first side 252 of outer cylinder 214—i.e., the particle is sheared.

In the illustrated embodiment, first side 248 and second side 250 of the first plurality of apertures 240 are angled and are parallel to each other. Similarly, first side 252 and second side 254 of the second plurality of apertures 242 are angled and are parallel to each other. This configuration is used only for the purpose of explanation, and other configurations are possible and within the scope of the invention. For example, other embodiments may use only one angled edge and may have non-parallel sides.

In the illustrated embodiment, each of the inner cylinder 212 and outer cylinder 214 is thick enough to support the shearing action without flexing or deforming. For example, each of the inner cylinder 212 and outer cylinder 214 may be between 1/16 and 1/4 inches thick. In the example embodiment, each of the inner cylinder 212 and outer cylinder 214 are 1/8 inch thick. In addition, each of the inner cylinder 212 and outer cylinder 214 may be made of a metal or metal alloy in order to provide sufficient rigidity for maceration. Alternatively, each of the inner cylinder 212 and outer cylinder 214 may be made from hard plastic, or any other suitably rigid material.

The inner cylinder 212 may be configured to fit within the outer cylinder 214 such that there is a small gap 266 between inner cylinder 212 and outer cylinder 214. More specifically, the diameter of an exterior surface 262 of the inner cylinder 212 may be slightly smaller than the diameter of an interior surface 264 of the outer cylinder 214. While the size of gap 266 may vary, gap 266 is preferably sized to enhance the shearing effect between inner cylinder 212 and outer cylinder 214. For example, in one embodiment gap 266 is less than about 1/16 inch (0.0625 inches).

Figure 7:
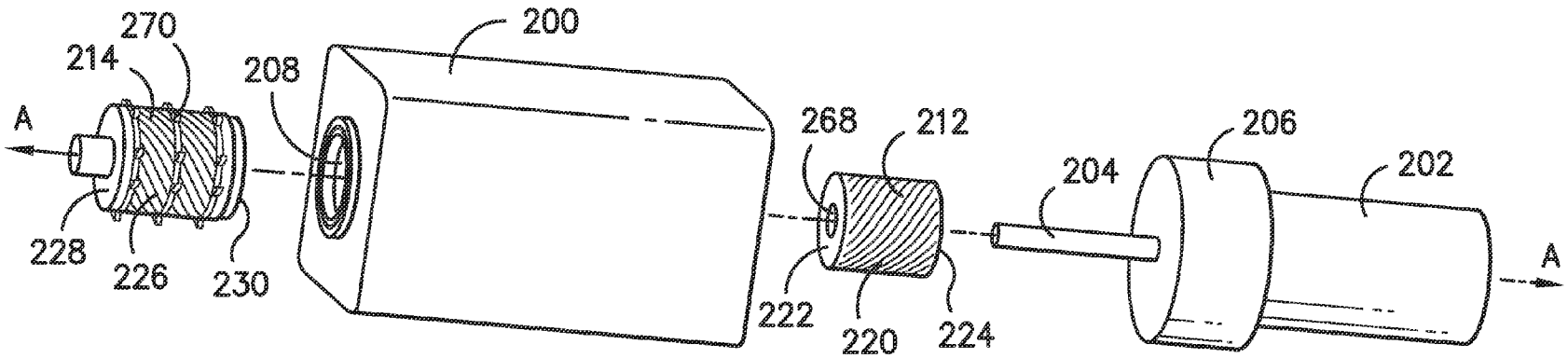
FIG. 7 provides a perspective, cross-sectional view of the inner and outer cylinder of a macerator assembly according to an exemplary embodiment of the present subject matter where the inner cylinder is configured to rotate.
Figure 8:
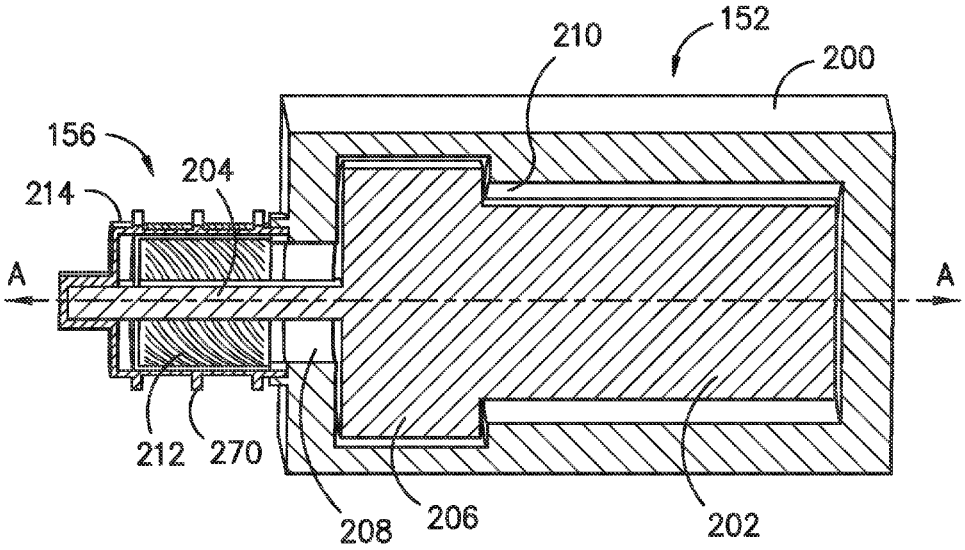
FIG. 8 provides a perspective, cross-sectional view of the inner and outer cylinder of a macerator assembly according to an exemplary embodiment of the present subject matter where the outer cylinder is configured to rotate.
Figure 9:
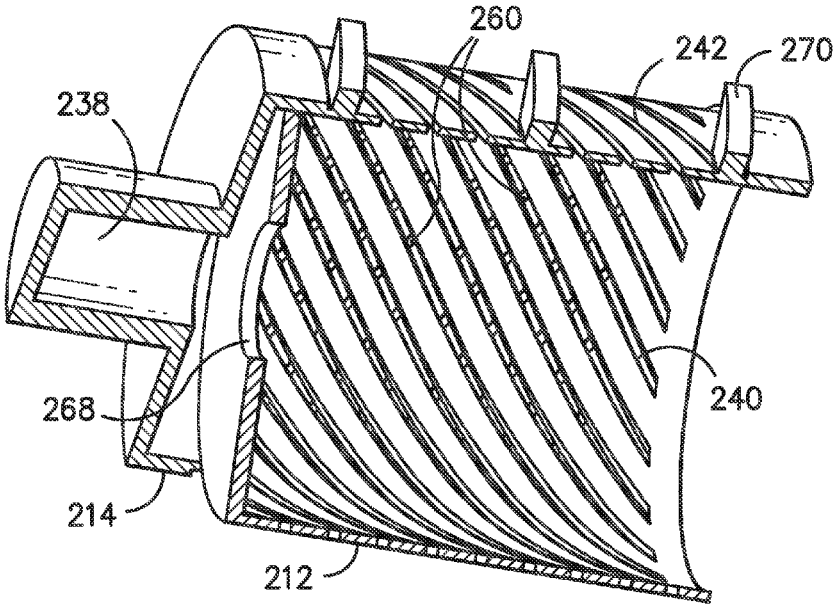
FIG. 9 provides a close-up, perspective, cross-sectional view of a shearing hole formed by the inner and outer cylinder according to an exemplary embodiment of the present subject matter.

In another embodiment shown in FIGS. 7 through 9, inner cylinder 212 is stationary while outer cylinder 214 rotates. To achieve this, the capped end 222 of the inner cylinder 212 may define an aperture 268 centered along longitudinal axis A and sized to allow drive shaft 204 to pass through. Drive shaft 204 may be attached to the capped end 228 of the outer cylinder 214 which is no longer fixed to the pump housing 200 at its open end 230. The inner cylinder 212, however, is fixed to the pump housing 200 at its open end 224. Therefore, as motor 202 rotates, the outer cylinder 214 rotates while the inner cylinder 212 remains stationary.

As best shown in FIG. 9, outer cylinder 214 may further include a plurality of projections 270 extending from an exterior surface 272 of the outer cylinder 214. Each of the plurality of projections 270 is configured to urge particles toward the exterior surface 272 of the outer cylinder 214. For example, the projections 270 may extend radially outward from the exterior surface 272 and project circumferentially in the same rotational direction as outer cylinder 214. Each projection 270 may thereby define a sloped surface that directs particles toward the exterior surface 272, where they are received in the shearing holes 260. When the outer cylinder 214 rotates, particles are hooked by the projections 270 and the angled surface urges the particles toward the exterior surface 272. One skilled in the art will appreciate, that the projections 270 can be any suitable shape, size, and orientation.

In the example embodiments, the impeller 206 and inner cylinder 212 rotate at the same speed because each is attached directly to drive shaft 204. However, one skilled in the art will appreciate that a transmission or gear box may be placed between the motor 202 and the inner cylinder 212 to rotate it at a different speed than the speed of the motor 202. For example, drive shaft 204 may be attached to the inner cylinder 212 through a transmission, which allows the impeller 206 to rotate at a higher speed than the inner cylinder 212. Similarly, in some embodiments, the drive shaft 204 could be connected to the outer cylinder 214 through a transmission.

A transmission may help to improve maceration efficiency. To illustrate, a typical dishwasher motor 202 and impeller 206 may need to rotate at around 3600 revolutions per minute (RPM) in order to move sufficient water for the cleaning operation. However, the inner cylinder 212 may not macerate food effectively at such high speed because the particles may have a tendency to clog, instead of pass through, the macerator assembly 156. Instead, macerator assembly 156 may have an optimal speed of rotation when the inner cylinder 212 is rotating, for example, around 100 RPM. The transmission enables rotation of the inner cylinder 212 at the lower speed while maintaining the optimal speed of the impeller 206. The optimal speed of rotation may depend on the size of inner cylinder 212 and outer cylinder 214, and the shape, size, and orientation of the shearing holes 260. The transmission can be configured to rotate the inner cylinder 212 at that optimal speed.

In another example embodiment, the macerator assembly 156 may include a separate motor for rotating one or more of inner cylinder 212 and outer cylinder 214. An additional transmission may also be used to enable the separate motor to rotate at a different speed or to rotate inner cylinder 212 and outer cylinder 214 in opposite directions. For example, a second motor could be disposed along longitudinal axis A outside of outer cylinder 214. The second motor shaft could be directly connected to the capped end 228 of outer cylinder 214. In this manner the outer cylinder 214 could be rotated in one direction, while the inner cylinder 212 either remains stationary or is rotated in the opposite direction by motor 202. One skilled in the art will appreciate that the above-described embodiments are used only to illustrate the subject matter of the present invention, and that other configurations are possible and within the scope of the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher, comprising:

a wash chamber for receipt of articles for washing;

a sump for collecting wash fluid;

a pump assembly for circulating wash fluid for cleaning the articles, the pump assembly having a motor, a shaft, a pump, a housing, an inlet in fluid communication with the sump, and an outlet in fluid communication with the wash chamber; and a macerator assembly configured with the pump assembly, the macerator assembly comprising an inner cylinder and an outer cylinder concentrically disposed along a longitudinal axis, the inner cylinder having a first plurality of elongated slots extending from a first end of the inner cylinder to a second end of the inner cylinder and forming a non-zero angle with the longitudinal axis, and the outer cylinder having a second plurality of elongated slots extending from a first end of the outer cylinder to a second end of the outer cylinder and forming a non-zero angle with the longitudinal axis, wherein at least one of the inner cylinder and the outer cylinder is rotated by the motor such that relative rotation between the inner cylinder and the outer cylinder causes the first plurality of slots and the second plurality of slots to act as shearing edges to macerate particles in the wash fluid.

2. The dishwasher of claim 1, wherein inner cylinder and the outer cylinder each have a capped end and an open end.

3. The dishwasher of claim 2, wherein the motor shaft is connected to the capped end of the inner cylinder and the outer cylinder is fixed to the pump housing, such that the motor rotates the inner cylinder relative to the outer cylinder.

4. The dishwasher of claim 2, wherein the inner cylinder is fixed to the pump housing and the motor shaft extends through an aperture in the capped end of the inner cylinder and is attached to the capped end of the outer cylinder, such that the motor rotates the outer cylinder relative to the inner cylinder.

5. The dishwasher of claim 4, wherein the outer cylinder further comprises a plurality of projections extending from an exterior surface of the outer cylinder and being configured to urge particles toward the exterior surface of the outer cylinder.

6. The dishwasher of claim 1, wherein the first plurality of elongated slots are defined by angled edges in the inner cylinder and the second plurality of elongated slots are defined by angled edges in the outer cylinder.

7. The dishwasher of claim 1, wherein an inner diameter of the outer cylinder is slightly larger than the outer diameter of the inner cylinder by about 0.0625 inches.

8. The dishwasher of claim 1, wherein the macerator assembly is disposed at the inlet of the pump assembly.

9. The dishwasher of claim 1, wherein the at least one of the inner cylinder and the outer cylinder is operatively coupled to the motor through a transmission.

10. The dishwasher of claim 1, wherein each of the first plurality of elongated slots are angled at approximately 45 degrees with respect to the longitudinal axis and each of the second plurality of elongated slots are angled at approximately −45 degrees with respect to the longitudinal axis.

11. The dishwasher of claim 1, wherein one of the inner cylinder and the outer cylinder is stationary.

12. The dishwasher of claim 1, wherein the motor is a first motor configured for rotating the at least one of the inner cylinder and the outer cylinder, the pump assembly further comprising a second motor for rotating the pump.

13. The dishwasher of claim 12, wherein the first motor rotates the outer cylinder in a first direction and the second motor rotates both the inner cylinder and the pump in a second direction.

* * * * *